US010420390B2

(12) United States Patent
Georgeson

(10) Patent No.: US 10,420,390 B2
(45) Date of Patent: Sep. 24, 2019

(54) HIGH HEEL SHOE INSERTS

(71) Applicant: Virve Tuulikki Georgeson, Ottawa (CA)

(72) Inventor: Virve Tuulikki Georgeson, Ottawa (CA)

(73) Assignee: Virve Tuulikki Georgeson (CA)

( * ) Notice: Subject to any disclaimer, the term of this patent is extended or adjusted under 35 U.S.C. 154(b) by 10 days.

(21) Appl. No.: 14/782,341

(22) PCT Filed: Apr. 3, 2014

(86) PCT No.: PCT/CA2014/000310
§ 371 (c)(1),
(2) Date: Oct. 5, 2015

(87) PCT Pub. No.: WO2014/165964
PCT Pub. Date: Oct. 16, 2014

(65) Prior Publication Data

US 2016/0044990 A1 Feb. 18, 2016

(30) Foreign Application Priority Data

Apr. 8, 2013 (CA) ..... 2812560

(51) Int. Cl.

| | |
|---|---|
| ***A43B 7/14*** | (2006.01) |
| ***A43B 7/28*** | (2006.01) |
| ***A43B 23/28*** | (2006.01) |
| ***A43B 21/00*** | (2006.01) |
| ***A43B 17/02*** | (2006.01) |
| ***A43B 17/14*** | (2006.01) |
| ***A43B 17/18*** | (2006.01) |

(52) U.S. Cl.
CPC ..... *A43B 7/28* (2013.01); *A43B 7/142* (2013.01); *A43B 7/143* (2013.01); *A43B 7/145* (2013.01); *A43B 7/1425* (2013.01); *A43B 7/1435* (2013.01); *A43B 7/1445* (2013.01); *A43B 17/02* (2013.01); *A43B 17/14* (2013.01); *A43B 17/18* (2013.01); *A43B 21/00* (2013.01); *A43B 23/28* (2013.01)

(58) Field of Classification Search
CPC ... A43B 7/1445; A43B 7/1425; A43B 7/1435; A43B 7/145; A43B 23/28; A43B 17/02; A43B 17/14; A43B 17/18
See application file for complete search history.

(56) References Cited

U.S. PATENT DOCUMENTS 1,730,466 A * 10/1929 Mallott ..... A43B 7/142 36/140
1,814,514 A * 7/1931 Karlson ..... A43B 7/1415 36/182

(Continued)

OTHER PUBLICATIONS

Canadian Office Action dated Dec. 12, 2014.

*Primary Examiner* — Ted Kavanaugh
(74) *Attorney, Agent, or Firm* — Gerald E. Hespos; Michael J. Porco; Matthew T. Hespos

(57) ABSTRACT

An insert for high-heeled footwear comprises a forefoot insert having a raised portion, and an arch insert having a generally concave base adapted to fit against the heel of the foot to prevent the foot from sliding forward. The forefoot insert and arch insert are placed in high-heeled footwear. The raised portion is adapted to fit under the three middle toes to prevent forward movement of the foot.

11 Claims, 7 Drawing Sheets

(56) References Cited

U.S. PATENT DOCUMENTS

| | | | | | |
|---|---|---|---|---|---|
| 2,310,824 | A | * | 2/1943 | Wyant | A43B 7/142<br>36/145 |
| 2,381,846 | A | * | 8/1945 | Thomas | A43B 7/1415<br>36/140 |
| 2,411,901 | A | * | 12/1946 | Silver | A43B 7/1415<br>36/145 |
| 2,486,653 | A | * | 11/1949 | Hukill | A43B 7/142<br>36/141 |
| 2,613,456 | A | * | 10/1952 | Amico | A43B 7/142<br>36/180 |
| 4,020,570 | A | * | 5/1977 | Shames | A43B 17/14<br>36/44 |
| 5,063,692 | A | * | 11/1991 | Suginaka | A43B 7/142<br>36/43 |
| D623,837 | S | * | 9/2010 | McDonnell | D2/961 |
| 2005/0039349 | A1 | * | 2/2005 | Grisoni | A43B 7/1425<br>36/71 |
| 2006/0254092 | A1 | * | 11/2006 | Stevens | A43B 7/145<br>36/71 |
| 2009/0193683 | A1 | | 8/2009 | Igdari | |
| 2013/0238816 | A1 | | 9/2013 | Skog | |

* cited by examiner

HIGH HEEL SHOE INSERTS

FIELD OF THE INVENTION

The invention relates generally to orthotic shoe products. More particularly, the invention relates to inserts for footwear having a high-heel.

BACKGROUND

Women may want to wear high-heeled footwear for the fashion and the aesthetics. However, many women experience discomfort and foot pain while wearing high-heeled footwear. Consequently, many women do not wear high heeled footwear for a very long time. Often women will take off or not wear high-heeled footwear for activities such as dancing or extended walking. Moreover, often women will only wear high-heels for short periods of time or when they will not need to walk or stand for extended periods of time.

As a result of the discomfort, many women will not wear high-heeled footwear; and many women own high-heeled footwear that they do not wear or are only able to wear for limited amounts of time due to the discomfort.

High-heeled footwear is uncomfortable mainly due to the fact that when heels are worn the foot is placed an angle from between 20 degrees to over 30 degrees relative to the ground. Such an angle causes multiple problems for the wearer.

First, the toes may become crushed due to the foot sliding forward as a result of the angle of the foot. If the footwear has closed toes, the toes of the wearer will be pressed against the front and sides of the closed toe box. If the shoe is a sandal or opened toed shoe, the toes will be pressed into the straps. The prolonged wearing of shoes in which the wearer's toes are crushed may result in severe foot problems such as bunions, hammertoes, or Morton's neuroma (plantar neuroma).

Second, in open-toed shoes (peep toe) or sandals one or more of the wearer's toes may overhang the soles of the shoe creating an unaesthetic appearance, which is troubling because the wearer is likely wearing heels for their aesthetic appearance.

Second, the heel may slide forward, making the heel area of the shoe unstable because of the gap that may be created between the shoe and the wearer's heel. The support provided at the heel of the shoe is lessened as the heel of the foot and the heel of the shoe are further apart. The forward movement of the heel misaligns the foot in the heel area may cause the shoe fit poorly creating pain for the wearer. It may also allow for lateral movement of the wearer's heel. This problem is exacerbated in open back sling back shoes and sandals where the foot sliding forward may loosen the strap around the wearer's heel.

Third, the forward movement of the foot shifts more of the weight of the wearer off the heels and onto the balls of the feet, thereby crushing the forefoot as most of the weight may be borne by the balls of the feet or the metatarsal heads. The balls of the wearer's feet naturally receive a large portion of the wearer's weight due to the angle of the shoe, and if the foot is sliding forward then even less weight is borne by the heel and additional weight is borne by the already stressed forefoot.

All of these problems caused by the foot sliding forward may be exacerbated by movement. As the wearer walks, jogs, dances, etc. the foot may slide forward on each step because. The different movement of the foot, whether it is lateral or forward movement during each step may create a different unpredictable situation for each foot fall. Thus wearing high-heeled footwear may increase the chance of falling or twisting an ankle, due to the instability that may be caused by the movement of the feet within the footwear. This hazard may be increased with uneven or slippery walking surfaces.

Consequently, the longer the wearer wears the shoes and the more the wearer moves in the shoes the more uncomfortable they may become. The wearer may feel increasing pain in the forefoot from crushing, increased instability in walking as the foot muscles tire, and a burning pain in the balls of the feet from the downward pressure during each step.

There are currently two types of products that have been put forward to assist high heel wearers to be more comfortable. These are insoles and inserts. The insoles and inserts currently available have numerous problems. For example many of the existing insoles, and some of the inserts, require special shoes or shoes that have a large amount of space. These inserts and insoles may not be used in any all styles, sizes and types of high-heeled footwear that the wearer may own.

The existing partial inserts which may be placed in wider range of shoes do not effectively and comfortably address the problem of the forefoot sliding forward and being crushed. There are existing inserts that are placed in high-heeled sandals that have a ridge along the forefoot area to prevent the toes from overhanging the front of the sandal. However that ridge design may be uncomfortable because it does not follow the angle of the base of the metatarsals.

Many existing inserts and/or insoles have heel inserts or heel and arch inserts that raise the heel relative to the forefoot, thus increasing the angle of the foot in the shoe and increasing the weight born by the forefoot. Alternatively existing insoles and inserts may target the arch of the foot by increasing the weight borne by the arch. However, having inserts that cause the arch to bear weight may often be uncomfortable and cause pain.

Additionally, existing inserts and insoles are often specifically designed for an individual and cannot be readily customized for different feet. A wearer may be unable to purchase off the rack insoles or inserts that are suitable for the wearer's unique feet shape and size.

Finally, many of the existing inserts or insoles take up excessive space or are obvious when placed in certain high-heeled footwear, thereby ruining the aesthetic appearance sought by the wearer.

There are no inserts available that are designed to work together to make high heeled shoes comfortable and stable at all areas of foot, including the heel the arch and the ball of the foot. No existing inserts effectively stabilize the heel of the foot and prevent the foot from sliding forward.

Therefore, there is a need for an insert that will enable a wearer to comfortably wear high-heeled footwear of all styles and heel heights, regardless of the shoe manufacturer. There is also a need for an insert that a person may place in any high-heeled footwear in order to increase the comfort in order to wear the footwear for longer periods of time.

More specifically, an there is a need for inserts that may be inserted into existing high-heeled footwear without modifying the footwear themselves to increase the comfort of the footwear. Preferably, the inserts will not detract from the overall aesthetic appearance of the high-heeled footwear.

While the invention refers to high heeled footwear and particularly high heeled shoes for women, it is understood that the invention may be used in any footwear, including men's footwear, that has a two-inch, or higher heel. For example the invention may be used in cowboy boots or dress boots.

SUMMARY OF THE INVENTION

In a broad aspect, the present invention provides a two part insert for high-heeled footwear comprising: a forefoot insert having a raised portion, and an arch insert having a generally concave base adapted to fit against the heel of the foot to prevent the foot from sliding forward; wherein said forefoot insert and arch insert are placed in high-heeled footwear; and wherein said raised portion is adapted to fit under the three middle toes to prevent forward movement of the foot, and allow the big toe and little toe to rest firmly against the footwear.

In another broad aspect, the present invention provides a forefoot insert for high-heeled footwear, wherein said forefoot insert has a longitudinally extending raised portion wherein said raised portion is adapted to fit under the three middle toes to prevent forward movement of the foot; and wherein said raised portion is adapted to be placed in high-heeled footwear with the longitudinal axis of said raised portion at the same angle as the metatarsal heads, and allow the big toe and little toe to rest firmly against the footwear.

DETAILED DESCRIPTION

With reference to the drawings, different embodiments of the present invention will now be described.

Figure 1:
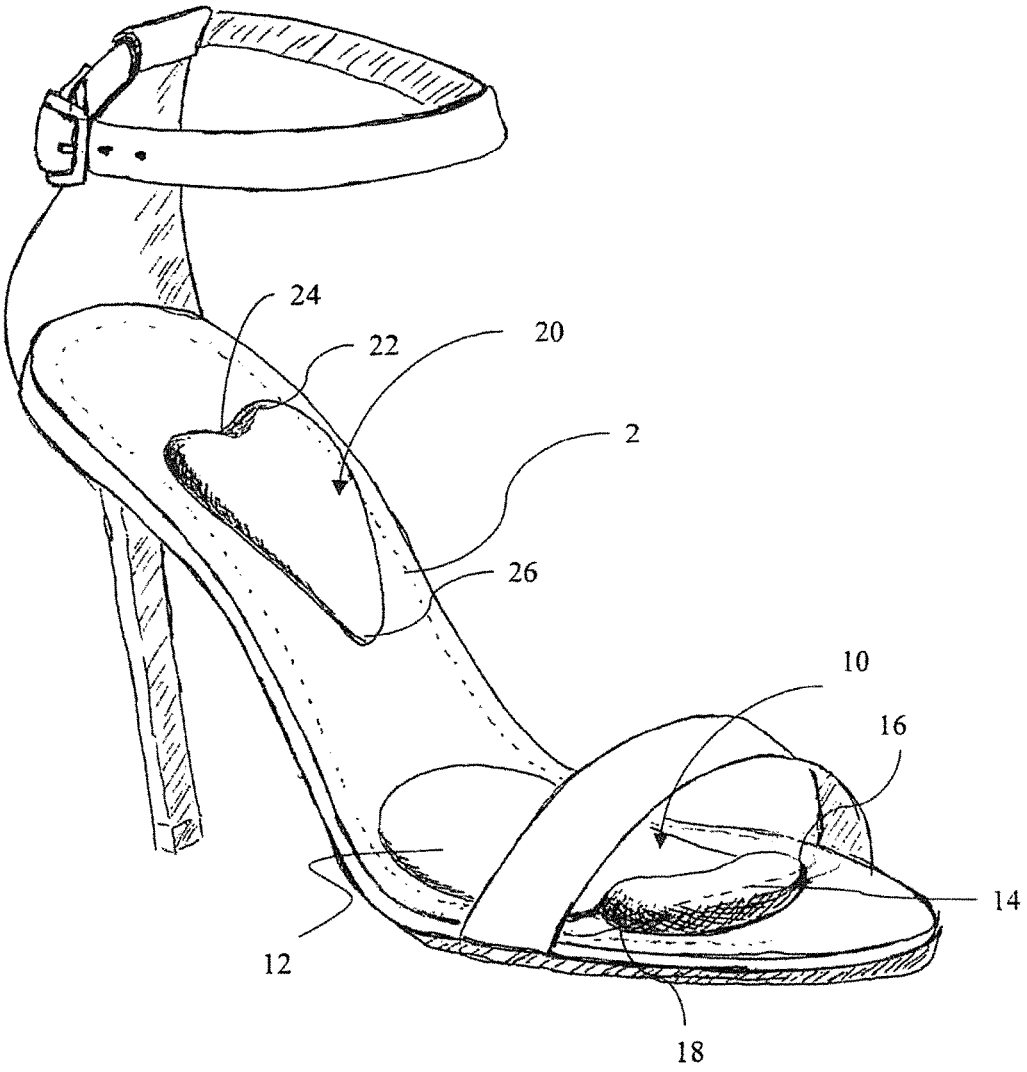
FIG. 1 is a perspective view of the inserts placed into a high-heeled shoe.
Figure 2:
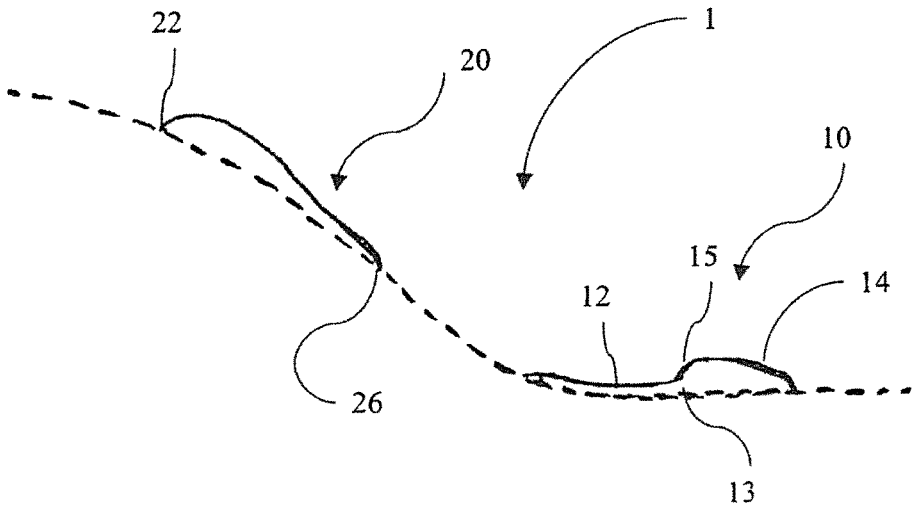
FIG. 2 illustrates a side plan elevation view of the inserts, shown on the outline of a high-heeled shoe insole.
Figure 3:
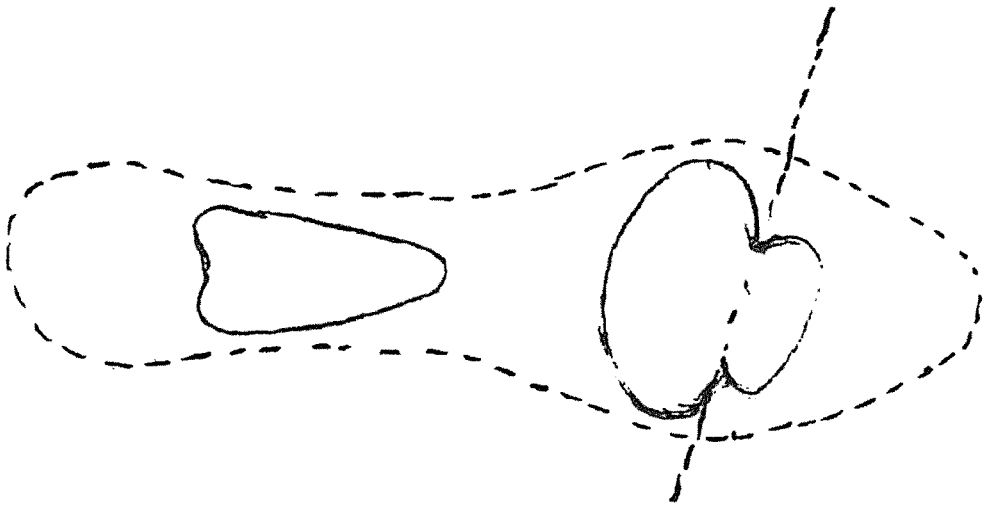
FIG. 3 illustrates a top view of the inserts shown on an outline of an insole.
Figure 4:
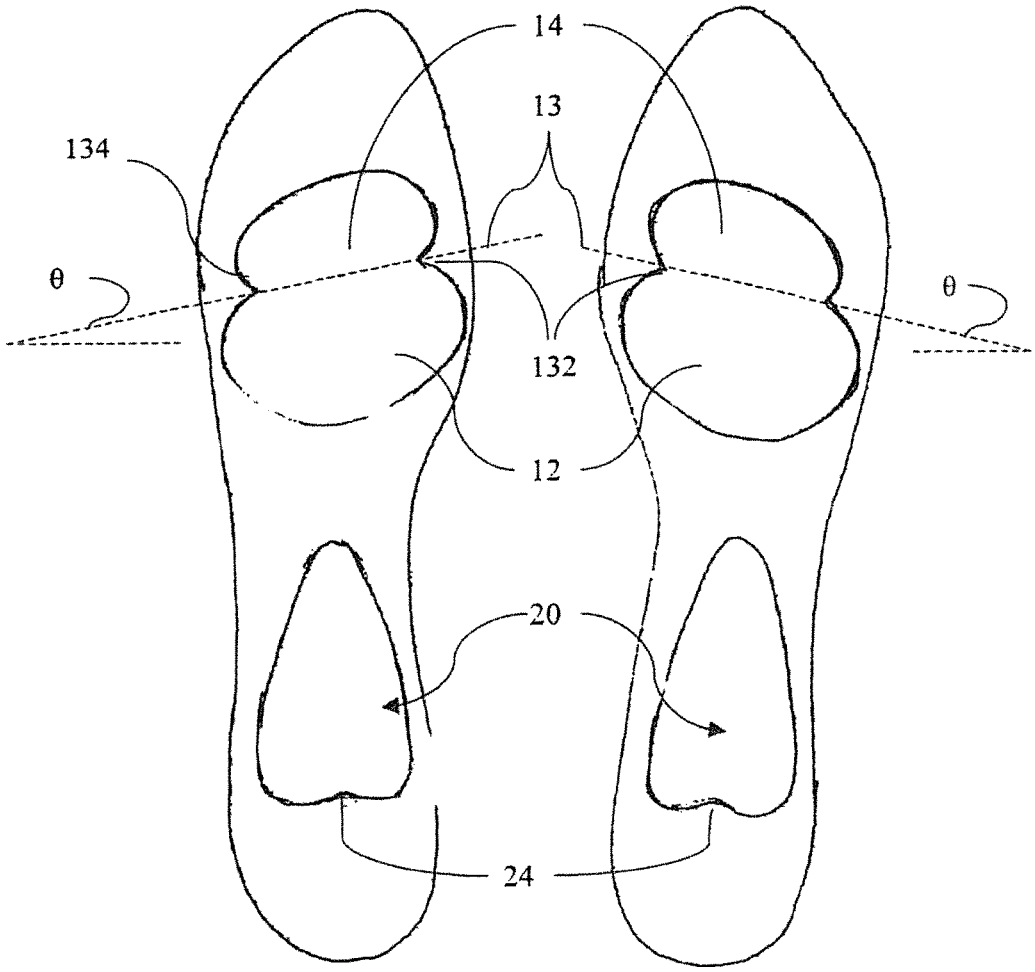
FIG. 4 illustrates a top view of the inserts as they sit on insoles.
Figure 5:
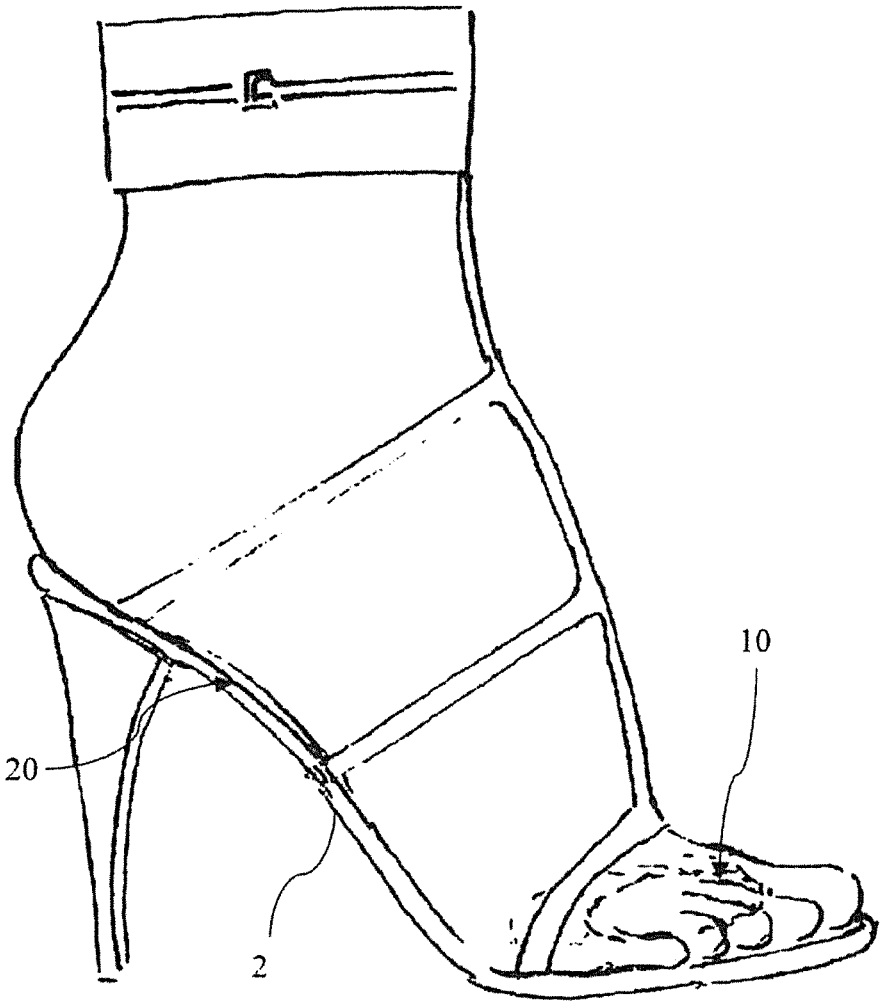
FIG. 5 illustrates a side elevation view of a foot in a high-heeled shoe with the inserts.

The high heel shoe inserts 1 of the present invention are illustrated best in FIGS. 1 to 4. In one embodiment there are two inserts, a forefoot insert 10 and an arch insert 20 that are placed in a high-heeled shoe 2. While, particular designs of high-heeled shoes are illustrated in FIG. 1 and FIG. 5 it is understood that inserts 1 may be placed in any style of high-heeled shoe 2 including high-heeled boots or sandals.

The benefit of the combination of two inserts is that it is effective in; stopping the foot from sliding forward or sideways; stabilizing the heel, and changing the point of balance of the shoe backward to take some of the weight off the balls of the feet. The two inserts 1 may fit into any snug fitting high heeled footwear that a person buys or already owns because it is adapted to take up no space in the footwear that is not already a naturally occurring space as will be discussed in greater detail below.

The forefoot insert 10 may be comprised of two generally oval shaped sections: a cushioning section 12 and a raised section 14. Cushioning section 12 and raised section 14 may join at intersection 13. In one embodiment, two notches 132, 134 are formed at the outside edges intersection 13 joining cushioning section 12 and raised section 14. Notches 132, 134 will therefore effectively divide the forefoot insert 10 into two lobes defined by the cushioning section 12 and the raised section 14.

In one embodiment, forefoot insert 10 may be adhered to the insole with intersection 13 at an angle θ corresponding to the angle of the line of the base of the toes of the wearer, as will be described in greater detail later. Angle θ corresponds to the angle of the metatarsal heads in relation to the longitudinal line of the foot and may correspond to an angle of about 12 to 20 degrees relative to longitudinal axis of the shoe. As can be seen in FIG. 4, the line defining the angle θ extends through the inner ends of notches 132, 134, therefore serving as a virtual dividing line between the lobe of the forefoot insert 10 defined by the cushioning section 12 and the lobe of the forefoot section 10 defined by the raised section 14. Moreover, if it is desired to utilize only the raised section 14 of the forefoot insert 10, the forefoot insert can conveniently be cut from the inner end of one notch 132 to the inner end of the other notch 134, as is noted below, but not shown in the drawings. Therefore, the virtual line from the inner end of one notch 132 to the inner end of the other notch 134 defines a common edge connecting the raised section 14 and the cushioning section 12 of the forefoot insert.

Cushioning section 12 may be about 2 mm thick and should be constructed out of a material that does not permanently compress or bottom out. The hardness of cushioning section 12 may be approximately shore 10-12. In one embodiment the cushioning section 12 is made from closed cell polyurethane (Poron™). However, it is contemplated that other materials could be used as would be understood by a person skilled in the art.

Cushioning section 12 may be adapted to fit under the ball of the foot of the wearer. The balls of the feet bear a large portion of the weight of a person wearing high-heeled shoes. Therefore, cushioning under the balls of the feet increases the comfort of high-heeled shoes. Cushioning section 12 may be be removed from forefoot insert 10 if there is sufficient cushioning built into a shoe.

The comfort of inserts 1 primarily comes from raised section 14 and arch insert 20, which have the effect of removing some of the wearer's weight from the ball of the foot and placing it on the heel, and from relieving pressure on the toes, as will be described in greater detail. However, after prolonged wear cushioning section 12 may become increasingly important as the ball of the wearer's foot is still bearing much of the weight of the wearer.

Raised section 14 may be adapted to fit under the middle three toes to reduce forward movement of the foot when it is in a high heel shoe or boot. Raised section 12, by fitting under the three middle toes, may only occupy space that already existed when a foot is in a high heel position.

The raised section has a steep slope 15 proximate to intersection 13. In use slope 15 may be adapted to be placed firmly against the anterior of the ball of the foot (against the heads of the metatarsals). In this embodiment raised section 14 and particular slope 15 may prevent the foot from sliding forward.

Optimally the placement of the raised section 14 in the shoe should be within about 2 mm from the anterior wearer's ball of the foot. If raised section 14 is too far forward it will not prevent the foot from sliding forward. If raised section 14 is too far backwards it will be uncomfortable as may put pressure on the ball of the wearer's foot. A method of ensuring proper placement of forefoot insert 10, including raised section 14, will be described in greater detail later.

In one embodiment raised section 12 has a height of 6 mm and tapers abruptly along slope 15 and gently to about 1 mm in the other directions to outside edges 16, 18 and front edge 19. Outside edges 16 and 18 may adapted to create spaces from the outside edge of shoe to raised section 14. The big toe will lay in the space between outside edge 16 and the edge of the shoe; the little toe will lay in the space between outside edge 18 and the edge of the shoe. The space between the big toe side of the shoe 2 and edge 16 of raised part 14 is preferably twice the size of the space required on the little toe side.

The spaces between the side of the shoe and raised section 14 may allow for the wearer to have a natural gait and to ensure that the toes are not squished into or forced under each other. Specifically, the big toe may be necessary for balance and for proper stride mechanics as the big toe pushes downwards while walking or running. Additionally the little toe may assist in providing balance to the outside of the foot. Therefore it is important to allow the big toe and little toe to have firm contact with the shoe.

Moreover, the lack of material under the big toe may insure that forefoot insert 10 takes up as little room as possible. The big toe is not pushed upwards as a result of forefoot insert 10, and therefore forefoot insert 10 can be used with any style of high-heeled shoe 2.

In addition to the functional advantage of having the big and little toe in firm contact with shoe 2, the big and little toes may also conceal forefront insert 10. In one embodiment forefoot insert 10 fits completely under the ball of the foot and under the three middle toes and may be substantially hidden by the foot regardless of the shoe type.

The raised section 14 may be made out of material that is stiff enough to prevent the foot from sliding forward, while also providing a cushion against which the ball of the foot can rest. In one embodiment raised section 14 is constructed from the same material as cushioning section 12. Raised section 14 may be constructed from closed cell foam such as Poron, however other materials are contemplated as would be understood by a person skilled in the art.

Forefoot insert 10 may be affixed to a high heel shoe using an adhesive. For example, forefoot insert 10 may have double sided tape or glue on the bottom. The adhesive used should be able to withstand the shear pressure created by the foot and should be heat and moisture resistant.

In one embodiment, especially for high-heeled footwear having a heel of less than about 2 or 3 inches, the forefoot insert 10 may be sufficient to increase the wearability of the footwear. However, in other embodiments, especially for high-heeled footwear with heels greater than 2 inches arch insert 20 used in conjunction with forefoot insert 10 may be necessary to increase the wearability of the footwear.

Arch insert 20 may be generally triangular in shape with a concave base 22 that forms an opening 24. Opening 24 is adapted to fit firmly against the anterior of the wearer's heel. The highest portion of arch insert 20 may be located proximate to base 22 and is adapted to be located immediately anterior of the heel and under the plantar fascia. Thus, arch insert 20 may prevent forward movement of the wearer's foot.

Arch insert 20 is adapted to fit into a naturally occurring space that may be created under the arch of the foot when the foot is in a high heel shoe. Arch insert 20 should not go under the heel. Increased height under the heel would increase the slope of the foot inside the shoe and make wearing high heels more problematic.

The thickest portion of arch insert 20 may be approximately 6 mm in height and is located proximate to base 22. The slope of arch insert 20 along base 22 may be tapered abruptly, with the remaining edges of arch insert 20 having a gentle taper.

Arch insert 20 may be adapted to be in contact with the bottom of the arch of the foot for only about 1-2 cm immediately anterior to the heel. Some downward pressure of the foot may be borne by the base 22 of arch insert 20 making the heel area larger and thereby taking some pressure off the ball of the foot.

The main function of arch insert 20 is preventing the foot from sliding forward by keeping the heel in place. Thus arch insert 20 may ensure that the heel of the shoe functions optimally to support as much of the weight of the wearer as possible, thereby removing some of the weight that may be borne by the ball of the foot.

In one embodiment arch insert 20 is about 5 cm long and 1.9 cm wide at its widest point. However, different dimensions and shapes are contemplated for different sized shoes and feet. The width of arch insert 20 should be less than the width of the insole of the shoe that arch insert 20 is placed in. Preferably arch insert 20 is dimensioned to be less obvious when shoe 2 is being worn. The unobtrusiveness of arch insert 20 is particularly useful for sandals or other open sided shoes.

Arch insert 20 may be placed along the center line of the arch of the wearer's foot. Alternatively arch insert 20 may be placed along the center-line of the shoe.

In one embodiment arch insert 20 is identical for left and right feet as it may not follow the underside contour of the arch. In other embodiments arch insert 20 may be dimensioned for the left foot and right foot respectively.

The placement of arch insert 20 relative to the back of the shoe is adjustable depending on the wearer's shoe size. In one embodiment the placement of arch insert 20 is proportional to the distance across the wearer's heel. Generally arch insert 20 is placed about 5 mm less than the width of the wearer's heel from the back of the shoe. For example a woman having size 8 feet generally has a heel are of about 5 cm, therefore arch insert should be placed about 4.5 cm from the back of the heel of the shoe. However, arch insert 20 can be adjusted backward or forward as desired.

The arch insert may be comprised of material that resists crushing or being pushed out of place and continues to support the foot. For example arch insert may be constructed from closed cell polyurethane such as Poron having a Shore hardness of 10-12. However, other materials are contemplated as would be understood by a person skilled in the art.

The arch insert may be attached to the insole of a shoe using an adhesive, for example double-sided tape or glue. The adhesive used must be able to withstand shear pressure, heat and moisture that result from the wearer's foot in the shoe. In one embodiment arch insert 20 has test strips of adhesive to allow arch insert 20 to be reversibly attached to the shoe, to ensure proper location. In one embodiment these test strips may be small pieces of protective covering that are removed from the adhesive on the bottom of arch insert 20.

As is best illustrated in FIG. 5, inserts 15 are substantially not visible when in use.

If desired for aesthetic purposes both or either of the inserts 1 may be coloured an appropriate colour or covered with a coordinated fabric in order to blend with the colour of the shoes interior.

In an alternative embodiment forefoot insert 10 and arch insert 20 may be incorporated into high heeled shoes that have an easily removable thin flexible insole by taking out the insole, inserting and affixing the inserts 1 under the insole, and replacing the insole overtop inserts 1.

In another embodiment a colour coordinated insole made from fabric, plastic, leather or the like can be placed over the inserts 1, thereby creating a custom shoe that appears to have the inserts placed into the shoe as part of the manufacturing process. This method will create an aesthetically pleasing shoe as inserts 1 will be hidden under the insole and will appear in the shoe only as contours not as objects attached onto the top of the insole.

In a further embodiment, the original shoe insole could be removed and replaced by a thin flexible foam insole, the inserts attached to the shoe in the correct places the thin flexible insole glued overtop of them.

In a final embodiment the inserts may be affixed to the shoe during the shoe's manufacture based on sizing guides.

Turning to FIGS. 6 to 11, an apparatus and method of attaching inserts 1 to create a customized fit in existing high-heeled footwear is illustrated. Parchment paper templates 100 marked right and left may be provided with inserts 1. Templates 100 may be generally in the shape of an insole that widens into a square shape 102 near the toe end 104. Parchment paper template 100's square portion 102 may wide enough for the user to trace both sides of the widest part of their foot onto it, as is illustrated in FIG. 6*c*.

Parchment paper template 100 also has a series of markings 108 near the heel 106 that correspond to different shoe sizes. In one embodiment shoe sizes 7 to 11 are marked, however different templates 100 may have larger and/or smaller sizes marked.

Figure 6A:
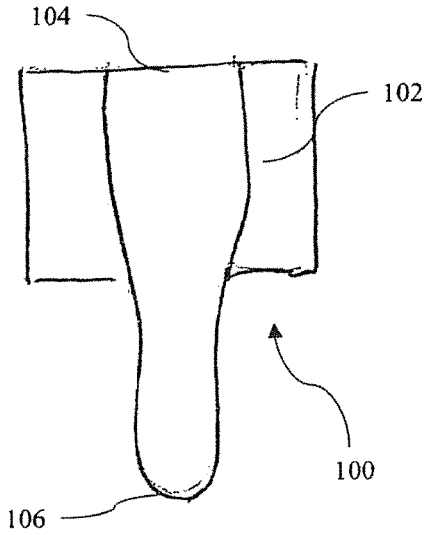
FIG. 6*a* illustrates a top view of the template of the present invention.
Figure 6B:
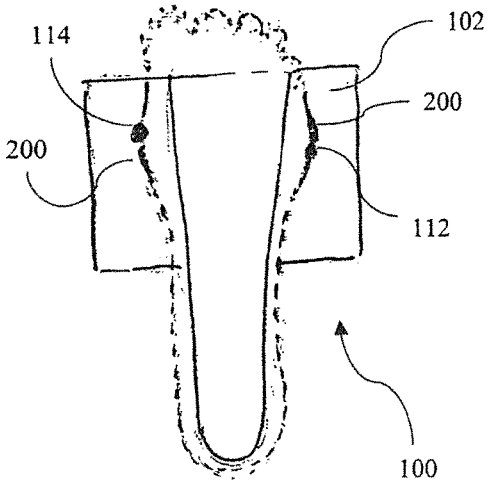
FIG. 6*b* illustrates a foot placed on the template for tracing.

The wearer may place a bare foot on template 100 on the floor or on any other flat hard surface (right template for right foot). The wearer centers his/her foot on template 100 with the back of the heel exactly even with the heel 106 of template 100. Then, the wearer traces the widest part of the foot 200 onto the template, as is illustrated in FIG. 6*b*.

Figure 7A:
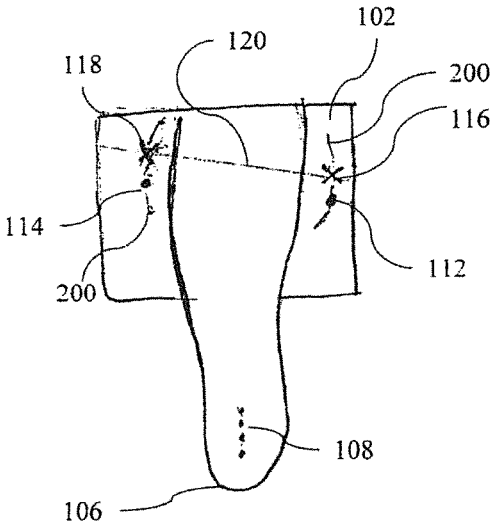
FIG. 7*a* illustrate a top view of the markings on the template for locating the forefoot insert.

The user places two large pencil dot 112 and 114 on the template 100 at the spots where the foot 200 is the widest, generally corresponding to the bumps at the base of the big and little toes as is illustrated in FIG. 7*a*.

The user then measures forward from each pencil dot 112, 114 for about 12 mm and marks a second spot X 116, 118 on each side as is illustrated in FIG. 7*a*. A line 120 is drawn connecting the two marks 116, 118, as is shown in FIG. 7*b*.

Forefoot insert 10 is then placed on template flat side down with cushioning section 12 placed towards heel 106 of template 100. The notches 132, 134 of forefoot insert 10 are positioned directly on pencil line 120, so that intersection 113 corresponds to line 120. Forefoot insert is positioned so that twice as much of line 120 is visible on the big toe side as on the little toe side, so that there is twice as much space between the insert and the edge of the insole on the big toe side as on the other side as is shown in FIG. 7*b*.

Figure 7B:
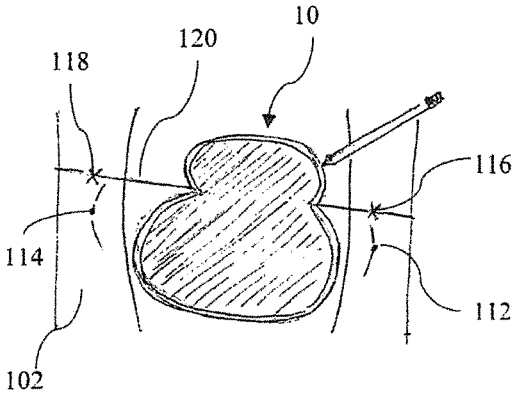
FIG. 7*b* illustrates a top view of the forefoot insert being traced onto the template.

The wearer may then trace shape 140 of forefoot insert 10 onto template 100 as shown best in FIG. 7*b*.

Figure 8A:
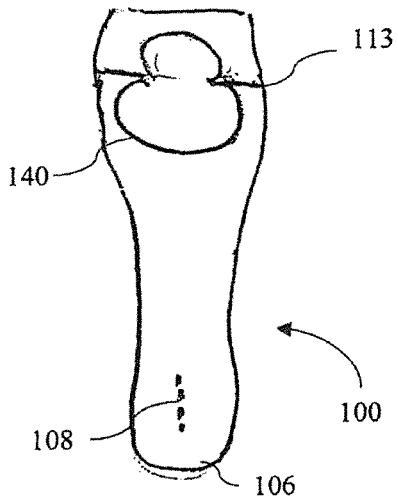
FIG. 8*a*-8*b* illustrates the template cut so that it may be inserted into footwear.
Figure 8B:
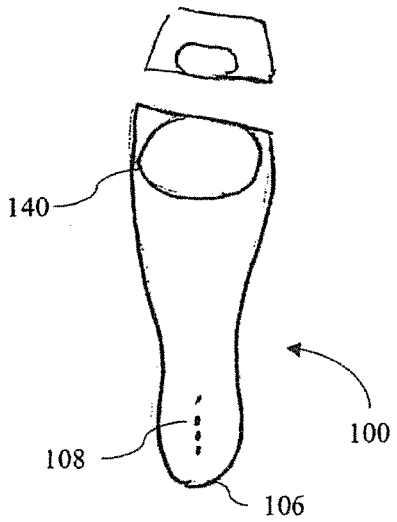
Figure 8C:
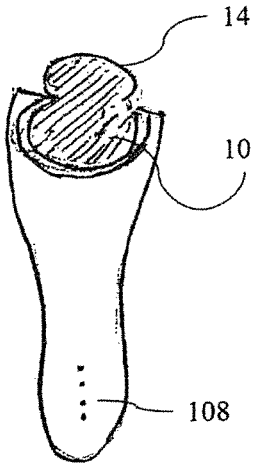
FIG. 8*c* illustrates the template with the forefoot insert attached fro insertion into footwear.
Figure 9:
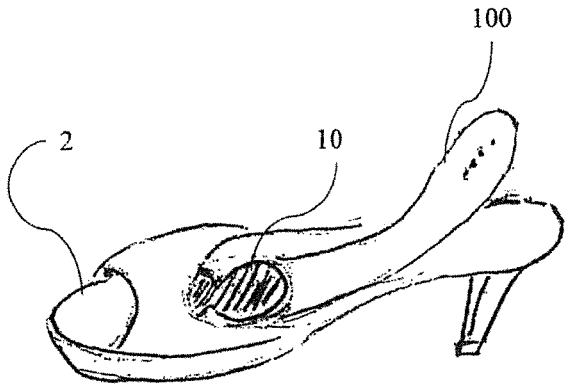
FIG. 9-10*b* illustrates the template with the forefoot insert being placed into a shoe and the template being removed.

The square portion 102 of template 100 may be cut-off or otherwise removed as is illustrated in FIG. 8*a* to allow template 100 to be easily inserted into a shoe. The template may then be cut across the straight pencil line 120 as is illustrated in FIG. 8*b*.

Forefoot insert 10 may then be affixed to template 100 where it was traced. In one embodiment, glue backing is removed from forefoot insert 10 and the glue reversibly affixes cushioning portion 12 of forefoot insert 10 to template 100.

Template 100 may then be placed in the shoe 2, with the template centered in shoe 2 and the heel 106 of template 100 at the heel of the shoe. Template 100 is adjusted to ensure that the space between the side of the shoe and the edge of raised section 14 is about twice as wide on the big toe side as on the little toe side.

Figure 10A:
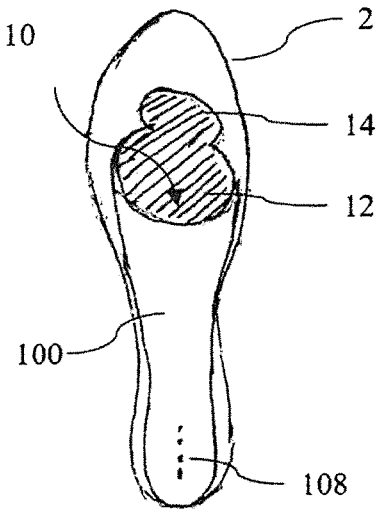
FIG. 10*c* illustrates the heel of the sole of the shoe being marked to locate the arch insert.
Figure 10B:
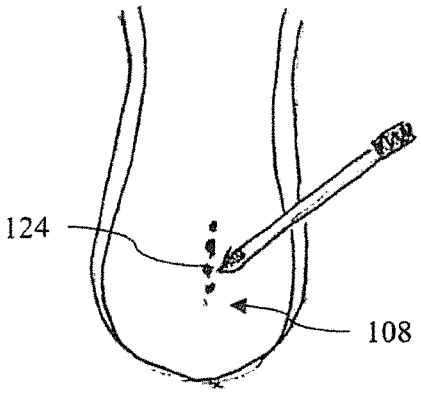
Figure 10C:
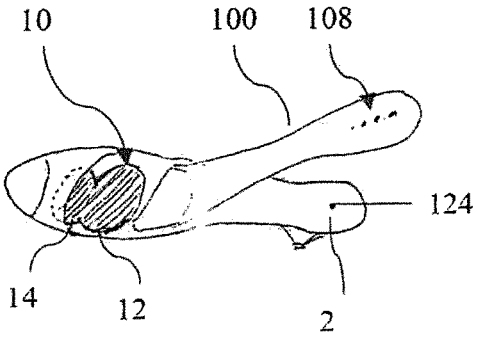

When the template 100 is placed in the shoe, the shoe may be marked 124 at the location of the dot 108 corresponding to the wearer's shoe size as is illustrated in FIG. 10*b*.

Raised portion 14 of forefoot insert 10 is then adhered to shoe 2 while the template is kept in position, (the heel of the template at the heel of the shoe). The template 100 may then be removed from under the insert and the cushioning section 12 of forefoot section 10 is then adhered to the shoe as is shown in FIG. 9*b*.

In shoes with sufficient cushioning under the ball of the foot, the cushioning section 12 of forefoot insert 10 may not be affixed to the shoe and will be removed with template 100 (not shown).

Figure 11:
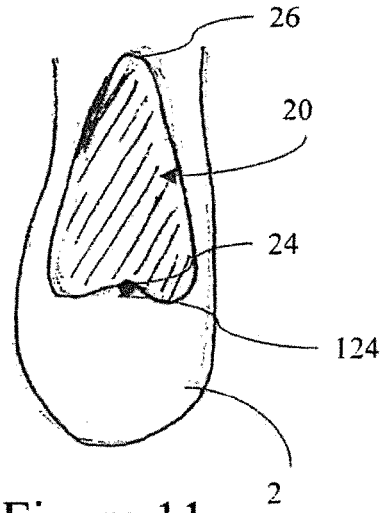
FIG. 11 illustrates the position of the arch insert in relation to the marked sole.

The arch insert 20 may be placed glue side down, with notch 24 of the arch insert 20 located at dot 124 that was marked on the shoe. Arch insert 20 may be centered in the shoe pointing the narrow end 26 towards the middle of shoe 2. Arch insert is then affixed to the shoe in this location as is illustrated in FIG. 11.

The wearer follows the same steps for the other shoe.

As discussed previously, in one embodiment arch insert 20 and forefoot insert 10 may be adjusted after initially being affixed to the shoe. In this embodiment the wearer can try on the shoe to ensure that the placement of inserts 10 and 20 are comfortable. Once the proper location of inserts 10 and 20 is ascertained, the wearer may fixedly attach inserts 10 and 20.

It is important that the inserts 10 and 20 are properly located. If not properly located the inserts 1 will not function optimally.

The above method discussed the wearer locating the inserts 1, however it is contemplated that a second person may assist in placing inserts 1 in the wearer's shoes.

While the invention ahs been described with reference to various embodiments, the scope of the claims should not be limited by the preferred embodiments set forth in the examples, but should be given the broadest interpretation consistent with the description as a whole".

What is claimed is:

1. A forefoot insert for high-heeled footwear, the high-heeled footwear having an insole for receiving a person's foot, the insole having locations for optimal placement of a big toe, a little toe, three middle toes disposed between the big toe and the little toe, and the metatarsal heads of each of the toes, wherein said forefoot insert comprises:

a bottom surface provided with an adhesive and adapted to be adhered to the insole of the high-heeled footwear, a rear end shaped, dimensioned and adapted to be placed backward of and in a substantially adjacent position to the location for optimal placement of the metatarsal heads of the toes, a front end adapted to be disposed laterally at the location of the three middle toes, a medial end adapted to be disposed laterally of the big toe, and a lateral end adapted to be disposed medially of the location for optimal placement of the little toe so that the insert is adapted to be inward of the locations for optimal placement of the big toe and the little toe, a top surface facing oppositely from the bottom surface and shaped to define a raised portion between the front and rear ends and between the medial and lateral ends of the insert, the raised portion adapted to be positioned at the location for optimal placement of the three middle toes to prevent forward movement of the foot of a person wearing the footwear; and wherein the raised portion is adapted to be placed in the high-heeled footwear with a longitudinal axis of said raised portion at the same angle as the location for optimal placement of the metatarsal heads, the positions of the medial and lateral ends of the footwear insert allow the big toe and little toe of the person's foot to be positioned outward of the insert and to rest firmly against the insole of the high-heeled footwear, and the forefoot insert has a cushioning portion connected to said raised portion adapted to cushion the forefoot, said insert having an inwardly directed notch along a medial edge thereof between the raised portion and the cushioning portion, and an inwardly directed notch along a lateral edge thereof between the raised portion and the cushioning portion, whereby the forefoot insert has two lobes defined by the raised portion and the cushioning portion, the two lobes being joined along a virtual line extending between the inner parts of the notches on the medial and lateral edges, wherein the cushioning portion can be separated from the raised portion by cutting the insert along said virtual line.

2. An insert as in claim 1, wherein said raised portion has a steep slope adapted to fit firmly against the anterior of the ball of the foot.

3. An insert as in claim 1 wherein said raised portion is constructed from a material having a Shore hardness of 10-12.

4. An insert as in claim 3, wherein said material of said raised portion is a closed cell polyurethane.

5. An insert as in claim 1, wherein a peak thickness of said raised portion is about 6 mm.

6. An insert as in claim 5 wherein said cushioning portion is constructed from a material having a Shore hardness of 10-12.

7. An insert as in claim 6, wherein said material of said cushioning portion is a closed cell polyurethane.

8. An insert as in claim 7, wherein a thickness of said cushioning portion is about 2 mm.

9. An insert as in claim 1, wherein a lower surface of said insert is coated with a contact adhesive for securing said insert to an insole of a shoe.

10. An insert as in claim 1, further comprising a releasable adhesive allowing said insert to be affixed on a temporary basis to the insole of the high-heeled footwear.

11. An insert as in claim 1, further comprising a permanent adhesive allowing the insert to be affixed permanently to the insole after it is ascertained that positioning of the insert is correct.

* * * * *